United States Patent [19]

Godino et al.

[11] Patent Number: 4,994,169

[45] Date of Patent: Feb. 19, 1991

[54] OIL RECOVERY PROCESS AND APPARATUS FOR OIL REFINERY WASTE

[75] Inventors: Rino L. Godino, Livingston; John D. Elliott, Jr., Randolph, both of N.J.

[73] Assignee: Foster Wheeler USA Corporation, Clinton, N.J.

[21] Appl. No.: 275,259

[22] Filed: Nov. 23, 1988

[51] Int. Cl.[5] ..... C01B 55/00

[52] U.S. Cl. ..... 208/50; 196/104; 196/105; 202/96; 201/2.5; 201/25

[58] Field of Search ..... 208/131, 50; 201/25, 201/2.5; 196/104, 105; 202/96

[56] References Cited

U.S. PATENT DOCUMENTS

| | | | |
|---|---|---|---|
| 3,876,538 | 4/1975 | Hess et al. | 201/21 |
| 3,917,564 | 11/1975 | Meyers | 208/131 |
| 4,007,094 | 2/1977 | Greenfield et al. | 202/174 |
| 4,013,516 | 9/1977 | Greenfield et al. | 201/2.5 |
| 4,118,281 | 10/1978 | Yan | 201/25 |
| 4,153,514 | 5/1979 | Garrett et al. | 201/25 X |
| 4,273,611 | 5/1981 | Blasio et al. | 159/47 WL |
| 4,289,578 | 9/1981 | Greenfield et al. | 159/17 R |
| 4,661,241 | 4/1987 | Dabkowski et al. | 208/131 X |
| 4,666,585 | 5/1987 | Figgins et al. | 208/131 |
| 4,839,021 | 6/1989 | Roy | 208/131 X |
| 4,874,505 | 10/1989 | Bartilucci et al. | 208/131 |

*Primary Examiner*—Curtis R. Davis

*Attorney, Agent, or Firm*—Marvin A. Naigur

[57] ABSTRACT

A process and apparatus for the recovery of oil from aqueous oil refinery waste involves mixing the waste with a fluidizing oil and evaporating the water from the mixture in a plurality of stages. The dewatered mixture is fed to a delayed coking system in which a conventional coker feedstock is being used. The heavy hydrocarbon portion of the dewatered mixture changes to coke and light hydrocarbon material, the inert solids become trapped in the coke, and the fluidizing oil vaporizes. A stream of heavy coker gas oil is fed from a fractionator in the delayed coking system to a fluidizing tank where it is mixed with the sludge to define the fluidizing oil. Another hot stream of hydrocarbon material from the coker fractionator is sent to the evaporator section to provide the heat for evaporation.

23 Claims, 1 Drawing Sheet

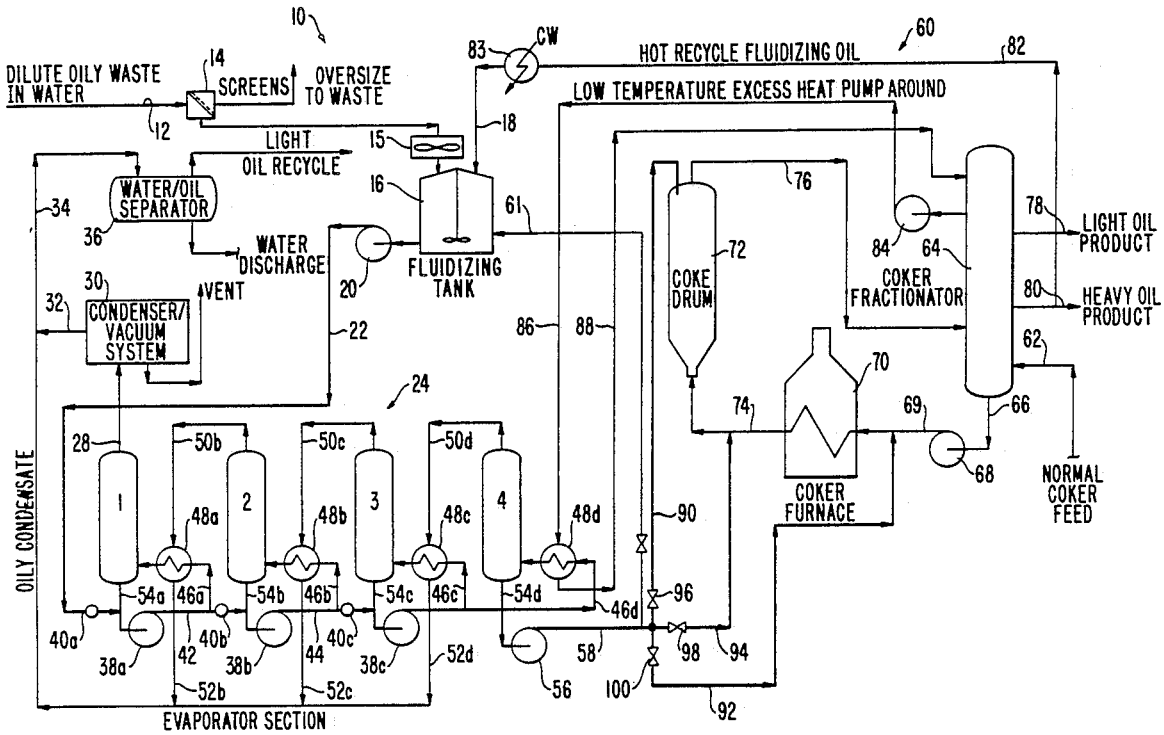

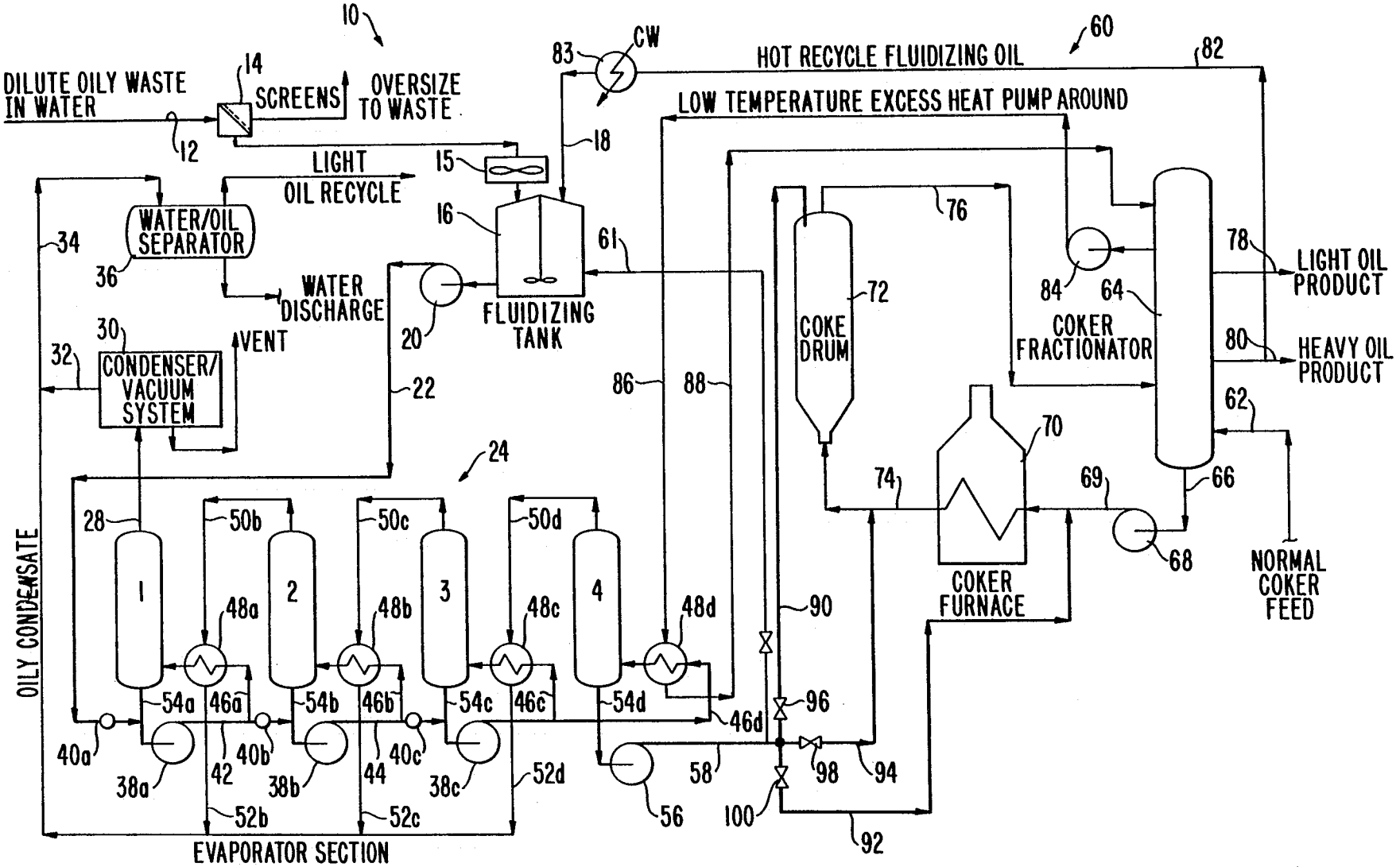
LIGHT OIL PRODUCT
HEAVY OIL PRODUCT
NORMAL COKER FEED
COKER FRACTIONATOR
COKER FURNACE
COKE DRUM
HOT RECYCLE FLUIDIZING OIL
LOW TEMPERATURE EXCESS HEAT PUMP AROUND
CW
FLUIDIZING TANK
OVERSIZE TO WASTE
SCREENS
LIGHT OIL RECYCLE
WATER DISCHARGE
VENT
WATER/OIL SEPARATOR
CONDENSER/ VACUUM SYSTEM
DILUTE OILY WASTE IN WATER
EVAPORATOR SECTION
OILY CONDENSATE

OIL RECOVERY PROCESS AND APPARATUS FOR OIL REFINERY WASTE

BACKGROUND OF THE INVENTION

The present invention relates to the recovery of oil from waste and, more particularly, to the recovery of oil from oily waste from oil refineries.

Oily waste having a heavy hydrocarbon portion and inert solids is carried in aqueous streams derived from diverse sources in an oil refinery, such as treatment lagoons, oily water systems, tank cleanings, and the like. Recovery of oil from this material is especially difficult due to the water content of the streams.

Processes are known which clean up and dispose of aqueous industrial wastes, sewage, brackish or salt waters, and other aqueous material, in part by evaporating the water of the aqueous material. In one process of the above type, exemplified by the process disclosed in U.S. Pat. No. 4,007,094 in the name of Charles Greenfield et al, the aqueous waste is mixed with a fluidizing oil, the water of the mixture is evaporated in a multiple-effect evaporation system, the fluidizing oil is recovered and recirculated, and waste solids are recovered by means of a centrifuge. The waste solids obtained by centrifuging still certain some oil. If recovery of this remaining oil from the solids is required, a hydroextractor is needed which passes steam through a chamber containing the waste solids to remove the remaining oil in the solids. Such a hydroextractor is disclosed as a cake deoiler in U.S. Pat. No. 4,289,578 to Charles Greenfield et al. The fluidizing oil multiple-effect evaporation process just described is effective but produces dry waste solids, which must still be disposed of. In addition, the process requires a substantial investment in equipment, which renders the process costly.

Many oil refineries have existing equipment for the production of coke by a delayed coking process. In a copending application assigned to the assignee of the present application, Ser. No. 185,617, filed on Apr. 25, 1988, now U.S. Pat. No. 4,868,407 it has been proposed to dispose of refinery sludges having high water content and solids by feeding them into a delayed coking system. In the process disclosed in that application, the wet sludge is fed to a blowdown drum of the delayed coking system for the removal of water.

SUMMARY OF THE INVENTION

By the present invention, a multiple-effect evaporation process involving the adding of a fluidizing oil is used to dispose of aqueous oil refinery wastes. Furthermore, the evaporation process is combined with a delayed coking process. As a result, oil refinery wastes obtain the benefits of the fluidizing oil multiple-effect evaporation process without the need for all of the equipment previously associated with such a process for removing the fluidizing oil, while at the same time the need to dispose of the dried waste and indigenous oil produced by such a process is eliminated.

in particular in the present invention, the aqueous streams of oily refinery waste are mixed with fluidizing oil, and the water is evaporated, as is conventionally done with aqueous industrial wastes, sewage, brackish or salt waters and the like in a multiple-effect evaporation process. However, the need for feeding a dewatered mix of fluidizing oil and waste solids to additional equipment in the fluidizing oil multiple-effect evaporation system is eliminated. No centrifuge or hydroextractor need be provided to recover fluidizing oil and indigenous oil. Instead, the dewatered mix of fluidizing oil and oily waste from the evaporator section of the fluidizing oil multiple-effect evaporation process is charged to the delayed coking system. The mix can be injected into the delayed coking system at the inlet of the coker furnace, at the inlet of the coke drum or drums, or into the top of the coke drum or drums. In the delayed coking process, a heavy hydrocarbon portion of the oily sludge undergoes coking reactions and changes to light material and coke; inert solids in the waste are trapped in the coke, contributing to its ash content; and the relatively light fluidizing oil vaporizes and passes overhead to the coker fractionator for recovery prior to recycling it back to the evaporation process. The method and apparatus according to the present invention produce no dried waste and indigenous oil which must be disposed of. In addition, the delayed coking process has excess low temperature waste heat, which is utilized to provide evaporation heat in the evaporation section of the process. In most applications, the amount of the mix of oil waste and fluidizing oil to be processed will be a small portion of the overall delayed coker feed and, thus, will have an insignificant effect on the operation of the coker and the quality of the coker products.

BRIEF DESCRIPTION OF THE DRAWING

The drawing figure is a schematic illustration of the integrated waste dewatering and delayed coking system according to the present invention.

DETAILED DESCRIPTION OF THE PREFERRED EMBODIMENT

As can be seen from the drawing figure, aqueous streams of oily refinery waste, which are relatively dilute, are fed into the waste dewatering and delayed coking system according to the present invention, which is designated generally by the reference numeral 10, through an inlet line 12. The waste is fed through screens 14, and then through a grinder 15 to a fluidizing tank 16, where a fluidizing oil is added through a line 18 and mixed with the waste. The resulting mix of aqueous oil waste and fluidizing oil is fed iron the fluidizing tank 16 by a pump 20 which delivers the mixture through a line 22 to a multiple-effect evaporator section, designated generally by the reference numeral 24.

The evaporator section 24 includes a plurality of stages, each having an evaporator tank, a heat exchanger, a pump, and associated valves and piping. In the embodiment illustrated, the evaporator section 24 includes first, second, third and fourth stages including evaporator tanks 1, 2, 3 and 4. The line 22 directs the stirred mixture of fluidizing oil and oily waste to the evaporator tank 1 of the first stage through a throttle valve, pump and heat exchanger to be described hereinafter. In the evaporator tank 1, water is boiled off from the mixture at a subatmospheric pressure, which may typically be about 2 to 10 inches Hg. This low pressure reduces the boiling point of the water in the mixture and, thus, the amount of heat needed for evaporating the water. A typical processing temperature for the mixture in the first stage is about 80 degrees F. to about 130 degrees F. Water vapor formed as a result of the partial dewaturing of the entering mixture of aqueous oily waste and fluidizing oil is removed from evaporator tank 1, along with vapors of the fluidizing oil, through a line 28 by a condenser/vacuum system 30, which feeds the vapor through lines 32 and 34 to a water/oil separator and/or coalescer 36. The water/oil separator 36 can be essentially a tank where the fluidizing oil has an opportunity to separate from the water, since the fluidizing oil is immiscible in the water. The water is drawn from iron one level of the water/oil separator 36 and discharged, whereas the fluidizing oil is drawn off at a different level. This fluidizing oil can be recycled to the fluidizing tank 16.

The pressures in the stages of the evaporator section 24 are not critical, but increase with each stage so that the pressure in the last stage or stages is close to atmospheric or higher. The pressures and the temperatures are controlled to give a desired evaporation rate. The processing temperatures in the later stages may be, for example, from about 130 degrees F. to about 170 degrees F. in the second stage, from about 150 degrees F. to about 200 degrees F. in the third stage,, and from about 190 degrees F. to about 230 degrees F. in the fourth stage. Although four stages are included in the illustrated embodiment, fewer or more stages can also be used in connection with the present invention.

The mixture of waste and fluidizing oil is boosted to the successive stages of the evaporator section 24 by pumps 38*a*, 38*b*, and 38*c*. A predetermined level of the mixture is maintained in the sumps of the evaporator tanks 1–3 by throttle valves 40*a*, 40*b* and 40*c* mounted in mixture feed lines 22, 42 and 44 just upstream of the pumps 38*a*, 38*b* and 38*c*, respectively. The throttle valves 40*a*–40*c* are controlled by level sensors mounted in the sumps of the tanks 1–3, respectively. When the level of the mixture in the sump of a tank, for example, tank 2, falls, the level sensor causes the upstream throttle valve, valve 40*b*, to open wider, increasing the flow of the mixture to the sump of tank 2. If the level of the mixture in the sump begins to rise above the predetermined level, the associated throttle valve is closed more so that flow to the sump is reduced. The presence of the throttle valve 40*b* causes a portion of the mixture from line 42 to be diverted through a line 46*a* and heated in a heat exchanger 48*a* before entering the evaporator tank 1 of the first stage, where some of the water and fluidizing oil evaporate. In the heat exchanger 48*a*, the mixture of aqueous waste and fluidizing oil is heated by steam and fluidizing oil vapors passing through the heat exchanger 48*a* after leaving the tank 2 of the second stage through a line 50*b*. After giving up their heat, the steam and oil vapors leave the heat exchanger 48*a* as an oily condensate through a line 52*b* leading to the line 34 and the water/oil separator 36.

Similar heat exchangers 48*b*, 48*c* and 48*d* and lines 46*b*–46*d* are associated with the second through fourth stages, respectively, and steam and oil vapors flowing from the tanks 3 and 4 of the third and fourth stages through lines 50*c* and 50*d* provide the evaporation heat for the mixture of waste and fluidizing oil entering the heat exchangers 48*b* and 48*c*, respectively. Thus, the mixture of waste and fluidizing oil flows through the evaporator section 24 in one direction, and the hot fluids providing the heat for evaporation of the water from the mixture flow through the evaporator section 24 in the opposite direction in a countercurrent arrangement. Oily condensate leaves the heat exchangers 48*b* and 48*c* through lines 52*c* and 52*d* leading to the line 34. After each stage, a decreased amount of water remains in the mixture of waste and fluidizing oil, but an increased amount of fluidizing oil is present to prevent the waste iron scorching and fouling the equipment. The additional fluidizing oil is obtained from the mixture of waste and fluidizing oil in the sumps of the tanks 1–3. The mixture is drawn off from the sumps through lines 54*a*–54*c* and added to the mixture being advanced to the next stage. The amount of water in the mixture of waste and fluidizing oil is progressively less in the sump of each tank until, in tank 4, there is little water remaining, and the dewatered mixture of waste and fluidizing oil is drawn off through a line 54*d* by a pump 56 and fed through a line 58 to a delayed coking section which is designated generally by the reference numeral 60. Depending on the nature of the waste, it may be necessary to recycle some of the dewatered mixture of waste and fluidizing oil back to the fluidizing tank through a line 61 in order to achieve good suspension of the dilute oily waste feed and the hot recycle fluidizing oil. The use of this method of recycle is known as "add back" and is disclosed in a process for dehydrating waste solids concentrates in U.S. Pat. No. 4,276,115 to Charles Greenfield et al.

The delayed coking section 60 receives a conventional coker feed from the refinery through a line 62 to a coker fractionator 64. A portion of the coker feed is evaporated in the fractionator, but the heavy bottoms portion is drawn off with other heavy hydrocarbons from the bottom of the fractionator 64 through a line 66 and fed by a pump 68 through a line 69 into a coker furnace 70 where the heavy hydrocarbon material is heated to a temperature, typically 900 degrees F. to 1000 degrees F., sufficient to form coke in a coke drum 72, to which the heated feedstock is fed through a line 74. Although a single coke drum is illustrated, it is known to employ two coke drums, and the use of a third coke drum has been proposed. Any number of coke drums which can be employed in a delayed coking process can be used in connection with the recovery process according to the present invention. In the coke drum 72, some light hydrocarbon material remaining in the heavy bottoms vaporizes and is taken off overhead from the coke drum 72 in a line 76 and fed to the coker fractionator 64. The remaining, heavier portions, form coke.

In the fractionator 64, various product streams are taken off, including a light coker gas oil stream through a line 78 and a heavy coker gas oil stream through a line 80. The light coker gas oil typically has an initial boiling point in the range of 350 degrees F. to 450 degrees F., and the heavy coker gas oil typically has an initial boiling point in the range of 650 degrees F. to 700 degrees F. In the recovery process according to the present invention, a portion of the heavy coker gas oil in line 80 is diverted via a line 82 to a heavy oil cooler 83, and then sent to the fluidizing tank 16 where it comprises the fluidizing oil for the evaporator section 24 of the system. Another hot stream of material, whose heat would otherwise be wasted, which can be called excess heat pumparound, is drawn oil from the coker fractionator 64 and fed by a pump 84 through a line 86 to the heat exchanger 48*d* where it provides the initial heat for the evaporation of water from the mixture of waste and fluidizing oil in the evaporator section 24. The cooled pumparound stream is returned to the coker fractionator 64 through a line 88.

The line 58 directing the dewatered mixture of waste and fluidizing oil to the delayed coking section 60 connects to three valved branch lines 90, 92 and 94 leading to different points in the delayed coking system 60. Branch line 90 directs the mixture of oily waste and fluidizing oil to the top of a coke drum 72. Branch line 92 directs the mixture to the line 69 containing the normal coker feed upstream of a coker furnace 70, so that the mixture is heated with the normal coker feed. Branch line 94 directs the mixture to the line 74 containing the normal coker feed downstream of the coker furnace 70 and just upstream of the coke drum 72. Control valves 96, 98 and 100 permit the flow of the mixture of oily waste and fluidizing oil through any one of the branch lines 90, 92 and 94, or a combination of the branch lines. In the coke drum 72, the heavy hydrocarbon portion of the oily waste undergoes coking reactions and changes to coke and light material which is taken off overhead from the coke drum. The inert solids in the oily waste are trapped in the coke, contributing to its ash content. The fluidizing oil, which is relatively light, vaporizes and passes overhead with the other light material through the line 76 to the coker fractionator 64.

Although a specific embodiment of the present invention has been disclosed herein, it is intended that various modifications can be made without departing from the spirit or scope of the present invention. The present embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

We claim:

1. A process for recovery of oil from oily waste having high water content, a heavy hydrocarbon portion and inert solids, comprising:

mixing the waste with fluidizing oil to form a mixture;

evaporating the water from the mixture to dewater the mixture; and feeding the dewatered mixture to a delayed coking process, including directing the dewatered mixture into a coke drum containing conventional coke feedstock and subjecting the dewatered mixture in the coke drum to coking conditions, whereby the heavy hydrocarbon portion changes to coke and light hydrocarbon material, the inert solids become trapped in the coke, and the fluidizing oil vaporizes.

2. The process of claim 1, further comprising taking the fluidizing oil from a fractionator in the delayed coking process.

3. The process of claim 1, wherein the dewatered mixture is fed into the coke drum at the top of the coke drum.

4. The process of claim 1, wherein the dewatered mixture is fed into the coke drum at the bottom of the coke drum.

5. The process of claim 1, wherein the dewatered mixture is fed through a coker heater in the delayed coking process and then to the coke drum.

6. The process of claim 1, wherein heat for the evaporating step is provided by a fluid stream taken from a coker fractionator in the delayed coking process.

7. The process of claim 1, wherein water evaporated from the mixture contains some fluidizing oil, the water being separated from the fluidizing oil in a coalescer.

8. The process of claim 7, wherein the fluidizing oil in the coalescer is included with the fluidizing oil mixed with the oil waste.

9. The process of claim 1, wherein the fluidizing oil for the mixing steps taken from a fractionator in the delayed coking process.

10. The process of claim 1, wherein the evaporating step is performed in a series of stages.

11. Apparatus for disposing of oily waste having high water content, a heavy hydrocarbon portion and inert solids, comprising:

means for mixing the waste with fluidizing oil to form a mixture;

means for evaporating the water form the mixture, said evaporating means producing vapors of water and fluidizing oil to leave a dewatered mixture of waste and fluidizing oil;

means for recovering fluidizing oil from the vapors of water and fluidizing oil;

means for producing coke by a delayed coking method, said coke producing means including a coke drum having an inlet at its bottom, a coker heater heaving an inlet, a coker fractionator, and means for conducting conventional coker feedstock through the coker heater to the coke drum; and means for feeding the dewatered mixture of waste and fluidizing oil from said evaporating means to said coke producing means, whereby the heavy hydrocarbon portion of the dewatered mixture changes to coke and light hydrocarbon material, the inert solids become trapped in the coke, and the fluidizing oil vaporizes.

12. The apparatus of claim 11, wherein said feeding means comprises conduit means for carrying the dewatered mixture to the top of the coke drum.

13. The apparatus of claim 11, wherein said feeding means comprises conduit means for carrying the dewatered mixture to the inlet of the coker heater.

14. The apparatus of claim 11, wherein said feeding means comprises conduit means for carrying the dewatered mixture to the inlet of the coke drum.

15. The apparatus of claim 11, wherein said feeding means comprises a first conduit extending from the evaporating means to the top of the coke drum, a second conduit extending from the evaporating means to the inlet of the coker heater, a third conduit extending iron the evaporating means to the inlet of the coke drum, and a control valve mounted in each of said conduits, whereby the dewatered mixture can be fed to any one of the top of the coke drum, the inlet of the coker heater, and the inlet of the coke drum, as well as to combinations of these locations.

16. The apparatus of claim 11, wherein said coker fractionator contains hot hydrocarbon fluids, the apparatus further comprising means for leading a stream of said hot hydrocarbon fluids to said heat exchanger to provide heat for evaporating water from the mixture of fluidizing oil and waste.

17. The apparatus of claim 16, wherein the evaporating means includes a heat exchanger, the mixture of waste and fluidizing oil flows through said first flow path, and said leading means extends from the coker fractionator to said second flow path, whereby the stream of hot hydrocarbon fluids flows to said heat exchanger to transfer heat to the mixture.

18. The apparatus of claim 11, wherein said coker fractionator contains hydrocarbon fluids, the apparatus further comprising means for guiding hydrocarbon fluid to said mixing means, said fluidizing oil comprising said hydrocarbon fluid.

19. The apparatus of claim 18, wherein said hydrocarbon fluid is heavy coker gas oil.

20. The apparatus of claim 11, further comprising means for separating the fluidizing oil from the water in the vapor.

21. The apparatus of claim 20, further comprising means for returning the separated fluidizing oil of the separating means to said mixing means.

22. The apparatus of claim 11, wherein said evaporating means comprises a plurality of evaporator tanks and means for feeding the mixture of waste and fluidizing oil serially through each of said evaporator tanks.

23. The apparatus of claim 11, wherein said coke producing means further includes means for sending light material form the coke drum to the coker fractionator.

* * * * *